United States Patent [19]

Fuhri

[11] 4,061,224

[45] Dec. 6, 1977

[54] CARRYING CASE FOR ART SUPPLIES

[76] Inventor: William F. Fuhri, R.R. 5, Box 84, Liberty, Mo. 64068

[21] Appl. No.: 728,112

[22] Filed: Sept. 30, 1976

[51] Int. Cl.[2] ..... B44D 3/00; B65D 25/04; B65D 25/54

[52] U.S. Cl. ..... 206/1.7; 206/45.34; 220/22

[58] Field of Search ..... 206/1.7, 1.8, 557, 45.34, 206/558, 561, 565, 214, 224, 538; 220/20, 22; 190/16

[56] References Cited

U.S. PATENT DOCUMENTS

| | | | |
|---|---|---|---|
| 1,175,070 | 3/1916 | Maxwell | 206/1.7 X |
| 1,973,283 | 9/1934 | Buttrick | 190/16 X |
| 2,372,077 | 3/1945 | Glinecki | 206/1.7 X |
| 2,940,200 | 6/1960 | Endlich | 206/1.7 X |
| 3,948,579 | 4/1976 | Schirmer | 220/20 X |

FOREIGN PATENT DOCUMENTS

| | | | |
|---|---|---|---|
| 558,343 | 6/1957 | Belgium | 206/214 |
| 533,356 | 12/1921 | France | 190/16 |
| 1,031,880 | 3/1953 | France | 206/1.7 |
| 617,824 | 11/1926 | France | 206/1.8 |

*Primary Examiner*—Robert S. Ward, Jr.
*Attorney, Agent, or Firm*—Lowe, Kokjer, Kircher, Wharton & Bowman

[57] ABSTRACT

A carrying case includes hinged together upper and lower sections in which art supplies are carried. The upper section presents a plurality of separate compartments which are adjustable in size and shape. A sliding cover panel fits over the compartments of the upper section. The lower section has an open bottom for the display of a picture which is fronted by a transparent panel and backed by a mat board. An inner frame member presses the panel and mat board together and provides a storage space in which a supply of paper is kept.

10 Claims, 4 Drawing Figures

Fig. 1.
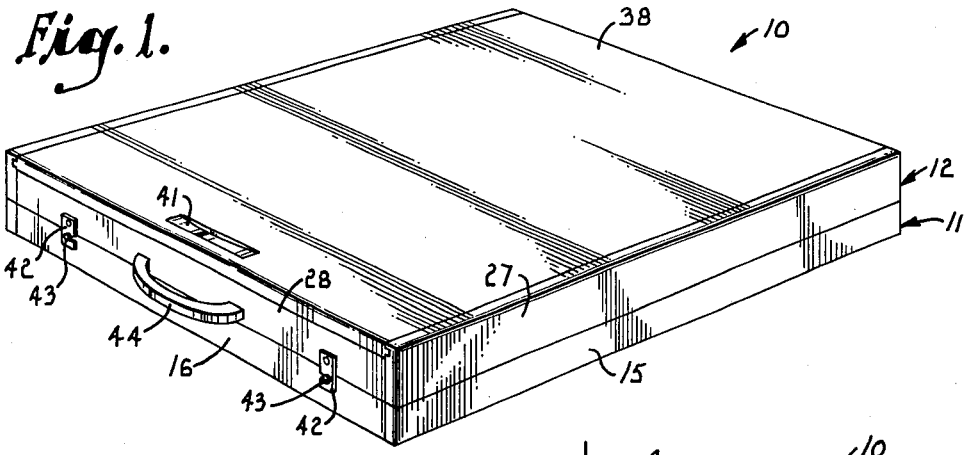
Fig. 2.
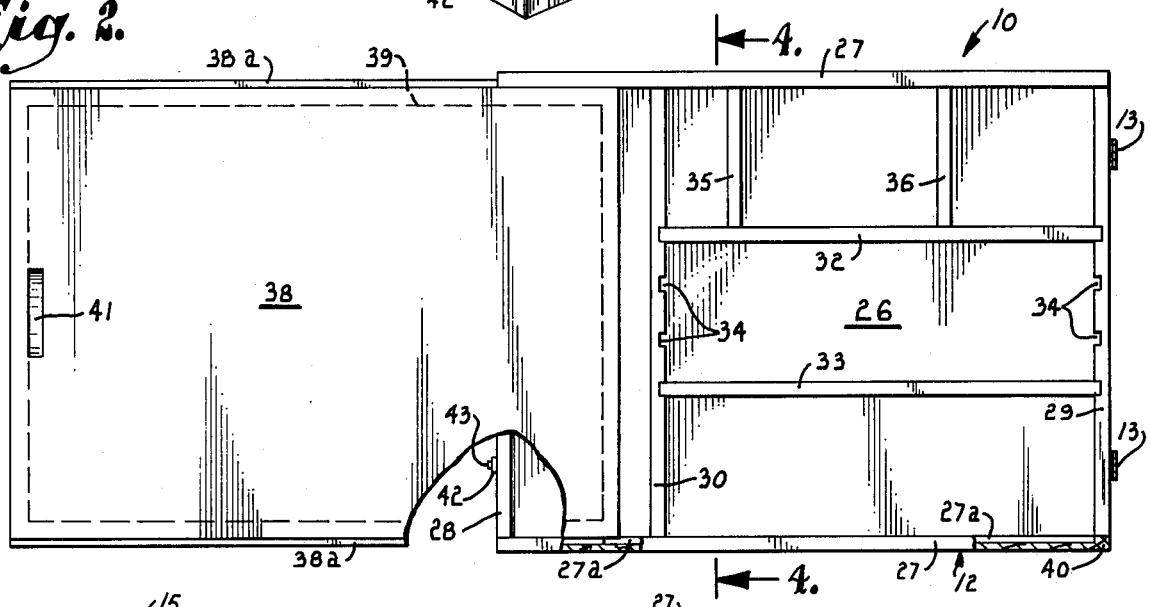
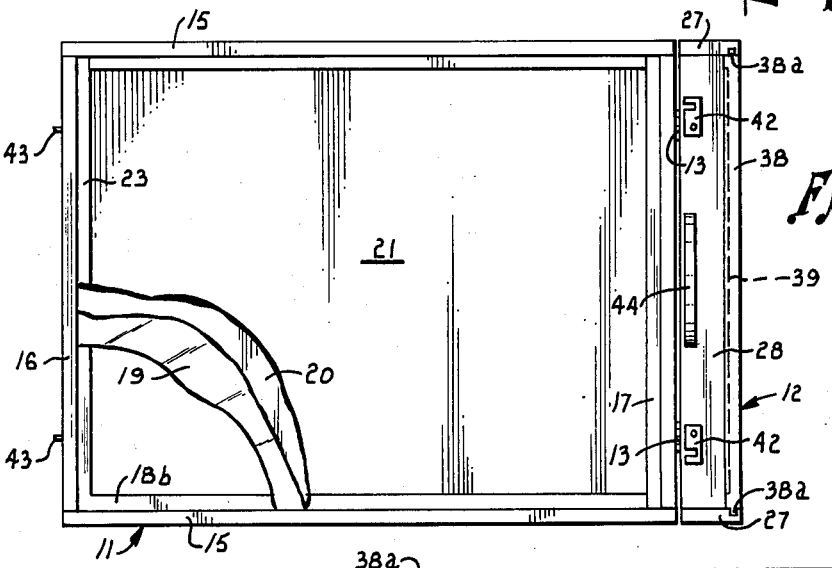
Fig. 3.
Fig. 4.
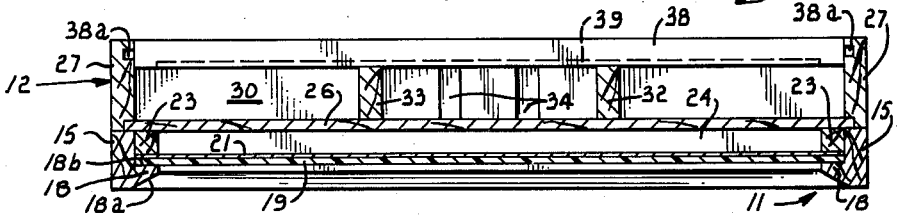

CARRYING CASE FOR ART SUPPLIES

BACKGROUND AND SUMMARY OF THE INVENTION

This invention relates generally to an improved carrying case for art related supplies such as drawing and water color material. More particularly, the invention deals with a carrying case that serves additionally as a display box for pictures and the like.

The boxes and cases that have been developed for carrying art supplies have not been entirely satisfactory in many respects. It is desirable for such cases to have a number of compartments in which to carry various items such as pens, pencils erasers, paper, water colors, brushes, and the like. However, in order to provide room for all of these supplies, existing cases are typically so large and bulky as to make them cumbersome to carry and otherwise handle. Moreover, even though compartments of various sizes are sometimes provided, the compartments are not readily adjustable in size in order to accommodate items that come in a variety of sizes and shapes.

Another problem with existing cases is that they typically provide an upper section that serves merely as a cover, or at best as a secondary storage area, rather than being a more functional part of the case. This type of arrangement not only fails to take full advantage of the area presented within the case, but it also adds to the difficulty involved in handling the case. To gain access to the contents, it is necessary to unlatch the rather large cover section, swing it upwardly to expose the contents, swing it back downwardly to close the case, and latch it to secure the case in its closed position. Existing cases are also lacking somewhat from an appearance standpoint, as well as being expensive to construct.

It is thus apparent that a need remains for a compact and economical carrying case for art supplies. It is the primary goal of the present invention to meet that need.

More specifically, it is an object of the invention to provide a carrying case which includes a pair of hingedly connected sections, both of which are able to contain various art supplies. It is an important feature of the invention in this respect that substantially the entire area of each section is available to carry supplies.

Another object of the invention is to provide a carrying case in which the upper section presents a plurality of compartments that contain various art supplies. In conjunction with this object, it is an important aspect of the invention that the upper section has a cover panel that slides in and out to open and close the compartments. Consequently, access to the contents of the compartments is facilitated as compared to conventional cases in which a large upper section must be swung fully open in order to expose the items contained within the lower section.

Still another important object of the invention is to provide a carrying case that also serves as a display box for displaying pictures and the like.

In conjunction with the preceding object, it is a further object of the invention to provide in a case of the character described, an attractive frame that borders the picture or other display item.

An additional object of the invention is to provide a carrying case in which the compartments are readily adjustable as to their size and shape.

Yet another object of the invention is to provide a carrying case that includes a cover panel which also functions as a drawing board.

A still further object of the invention is to provide a carrying case which is constructed economically yet durably and which is attractive in appearance.

Other and further objects of the invention, together with the features of novelty appurtenant thereto, will appear in the course of the following description.

DETAILED DESCRIPTION OF THE INVENTION

In the accompanying drawing which forms a part of the specification and is to be read in conjunction therewith and in which like reference numerals are used to indicate like parts in the various views:

FIG. 1 is a perspective view of a carrying case constructed according to a preferred embodiment of the present invention, with the case latched in its closed position;

FIG. 2 is a top plan view of the carrying case shown in FIG. 1, with the cover panel slid outwardly to a nearly fully open position and with portions broken away for illustrative purposes;

FIG. 3 is a top plan view of the carrying case, with the upper section swung upwardly approximately 90° from the FIG. 1 position to an open position and with portions broken away for illustrative purposes; and FIG. 4 is a cross sectional view taken generally along line 4—4 of FIG. 2 in the direction of the arrows.

Referring now to the drawing in more detail, reference numeral 10 generally designates a carrying case in which art supplies are contained. The carrying case 10 includes a box-like lower section 11 to which a box-like upper section 12 is pivoted by a pair of conventional hinges 13 (see FIGS. 2 and 3).

With particular reference to FIG. 3, the lower section 11 is an open bottomed structure which has a pair of parallel side walls 15, a forward wall 16 and a rear wall 17. A continuous lip 18 (FIG. 4) projects inwardly from the walls of section 11 at the lower portions thereof. Lip 18 is preferably integral with the walls and is beveled on its underside as indicated at **18*a* in FIG. 4. The lip has a flat upper shoulder surface 18*b* which receives a transparent plexiglass panel 19 near the peripheral edges thereof. Panel 19 is rectangular, and shoulder 18*b* extends completely around section 11 as best shown in FIG. 3 to provide a firm support on which panel 19** rests.

A picture 20 (FIG. 3) or another flat display item is received on top of panel 19 with the picture side facing downwardly. As previously indicated, the area inwardly of lip 18 is open so that the picture 20 may be viewed through the transparent panel 19 from the underside of the case. A flat rectangular mat board 21 is placed on top of picture 20 to provide a backing for same. Mat board 21 is removable to permit replacement of picture 20 or another display item, while panel 19 is also removable from the case.

A removable inner frame 23 acts essentially as a press to retain picture 20 in a flat condition sandwiched between the plexiglass panel 19 and the mat board 21. Frame 23 is a hollow rectangular structure having a size and shape similar to shoulder **18*b*. Frame 23 rests on top of mat board 21 against the walls of section 11 and at a location directly above shoulder 18*b*, and its upper surface is flush with the upper edges of the walls of section 11**. With the frame, a suitably sized rectangular space 24 (FIG. 4) is presented to receive a supply of paper of the type used for sketches and drawings.

The upper section 12 has a flat floor panel 26, a pair of opposite side walls 27 (see FIG. 2), and front and rear end walls 28 and 29. The area within the walls of the upper section is divided into a plurality of separate compartments for containing the art supplies. To form the compartments, a partition 30 is secured to extend upwardly from floor 26 and laterally between the side walls 27. Partition 30 is parallel with the front wall 28 and cooperates therewith to present a forward compartment in which brushes, pens, pencils, and other items may be carried.

A pair of parallel partitions 32 and 33 extend between partition 30 and the rear wall 29. Partition 32 is secured in place, while partition 33 may be moved in order to vary the size of the compartments which it forms in cooperation with partition 32 and with one side wall 27. Several sets of grooves 34 are formed in partition 30 and wall 29 to receive the opposite edges of partition 33 and thus hold it in place. Partition 33 may be pulled upwardly out of each set of grooves 34 and installed in another set of grooves to change its position. A pair of relatively short partitions 35 and 36 are parallel to one another in extension between partition 32 and one side wall 27, thus providing three relatively small compartments.

It is to be understood that various of the partitions other than partition 33 may be adjustable in position in order to provide compartments having a wide variety of sizes and shapes. To this end, each partition may be notched so that it will interfit with other partitions to present various size and spatial arrangements of the compartments. The partitions may be oriented either transversely or longitudinally of the case, depending upon the desired locations of the compartments. Also, there may be any number of partitions, depending upon the number of compartments that are to be formed.

A cover panel 38 normally covers the top of the compartments that are located within section 12. Referring to FIG. 4 in particular, tongues 38*a* are formed along the side edges of cover panel 38 and are received in corresponding grooves 27*a* (FIG. 2) that are formed in the side walls 27 near the top thereof. The tongue and groove connection permits the cover panel to slide in and out between a closed position (FIG. 1) and an open position wherein the compartments within section 12 are exposed. The cover may be completely removed from the case by pulling it outwardly beyond the position shown in FIG. 2.

A mat board 39 (FIG. 4) or another type of substance suitable upon which to draw is secured to the underside of panel 38. Mat board 39 is preferably recessed slightly from the edges of panel 38 and is mounted in a small cavity area formed in the panel underside such that its surface is flush with that of the panel. Mat board 39 provides a drawing surface when panel 38 is used as a drawing board, as will be explained.

With continued reference to FIG. 2, grooves 27*a* do not extend the full length of side walls 27 but instead terminate at the forward surface of the rear wall 29. A stop 40 is presented at the end of each groove 27*a* to engage the rearward end of tongue 38*a* and thus prevent the cover panel from sliding out to the rear. The end of each tongue 38*a* is recessed forwardly of the rear edge of panel 38 so that it will engage stop 40 with the cover panel fully closed in a flush position covering section 12. As an alternative to the stop arrangement for the cover, any type of releasable latch mechanism may be provided, and in this case the cover panel may be slid out in either direction when the latch is released.

A recess 41 is formed in the top surface of panel 38 to receive the fingers and thus facilitate sliding of the cover panel between its open and closed positions. A pair of hook type latches 42 are pivoted to the front wall 28 of upper section 12. The latches engage pins 43 which extend outwardly from the front wall 16 of lower section 11. The latches 42 and pins 43 retain the upper section closed on the lower section so that the floor panel 26 of section 12 completely covers the top of section 11 (see FIG. 4). A handle 44 for carrying the case is provided on one of the walls 27.

With the case closed as shown in FIG. 1, it may be carried with all of the necessary art supplies contained within it. A supply of paper is carried within the lower section 11, while the remaining supplies are contained within the separate compartments of upper section 12. The picture 20 which is sandwiched between panel 19 and mat board 21 is readily visible through the bottom of the case, and it may be displayed by standing the case on one end or side. The carrying case thus serves as a display box for the picture and provides an attractive frame that borders same (lip 18 and particularly its beveled edge 18*a*).

To gain access to the supplies contained within section 12, it is only necessary to slide cover panel 38 outwardly either fully or partially to expose the compartments in which the supplies are contained. The provision of a compartmentalized tray in the upper section is a considerable improvement over cases in which compartments are located in the bottom section. Such cases require that an entire upper section (which often comprises approximately half of the entire bulk of the case) be raised to gain access to the supplies in the lower compartmentalized section.

The cover panel 38 is preferably a solid member of good quality wood which presents a smooth, flat upper surface. Thus, the upper surface of the panel may provide a drawing board surface on which drawings and sketches may be made. However, it is contemplated that drawing will normally be done on the mat board 39, and that panel 38 will be completely removed when it is to be used as a drawing board. In addition, to position panel 38 on the case with mat board 39 facing upwardly to present a drawing surface, panel 38 may be removed, inverted, reinserted in its inverted position, and fully closed such that mat board 39 faces upwardly. Since the mat board is normally on the underside of the panel, it will be clean so as not to soil the paper which is placed thereon when drawings and sketches are to be made.

A paper supply is located in the space 24 presented within the inner frame 23, and the paper may be reached by unfastening latches 42 and swinging section 12 upwardly to expose the interior of section 11 (as in FIG. 3). When section 12 is closed as shown in FIG. 4, its floor panel 26 covers the lower section to retain the paper therein and, the floor panel also firmly presses the inner frame 23 downwardly against mat board 21 to securely retain the picture in a flat condition.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawing is to be interpreted as illustrative and not in a limiting sense.

Having thus described the invention, I claim:

1. In a carrying case for art supplies, the combination of:

an upper section having a plurality of walls and a floor panel;

a plurality of partitions disposed within said upper section to divide same into a plurality of separate compartments each adapted to carry supplies;

a cover for said upper section coupled with the walls thereof for opening and closing movement to open and close said compartments from the top thereof;

a lower section bounded by walls and presenting a substantially hollow interior between said walls for carrying supplies; and means pivotally coupling said upper section to said lower section for movement between a closed position wherein the floor panel of said upper section extends over said lower section in extension between the walls thereof to substantially cover the interior of said lower section, and an open position wherein the interior of said lower section is open at the top.

2. The combination of claim 1, including means for adjusting the location of at least one of said partitions to vary the sizes of the associated compartments.

3. The combination of claim 1, including a rigid transparent bottom panel for said lower section mounted beneath the hollow interior thereof and providing a rigid support for supplies carried within said lower section, whereby a display item may be viewed through said transparent panel from the bottom of said lower section.

4. The combination of claim 3, including a press member disposed within said lower section above the display item, said floor panel of the upper section and press member being constructed and arranged to cooperate in a manner to press the display item downwardly against said transparent panel when said upper section is in its closed position.

5. The combination of claim 4, wherein said press member presents an open interior region therewithin located within said lower section for receiving a supply of paper.

6. The combination of claim 1, including:

a lip extending substantially completely around the periphery of said lower section beneath the hollow interior thereof, said lip having an underside which is beveled and a top side which presents a substantially flat shoulder; and a rigid transparent bottom panel for said lower section supported on said shoulder, whereby a display item may be viewed through said transparent panel from the bottom of said lower section.

7. The combination of claim 6, including means for pressing the display item downwardly against said transparent panel.

8. The combination of claim 1, wherein said cover comprises a solid panel member coupled with the walls of said upper section for sliding movement to open and close said compartments.

9. In a carrying case for art supplies, the combination of:

an upper section having a plurality of walls and a floor panel, said upper section presenting a container for art supplies between the walls thereof and above said floor;

a cover coupled with said upper section for opening and closing movement to open and close said container from the top thereof;

a lower section bounded by walls and presenting a substantially hollow interior between said walls for carrying supplies;

a rigid transparent bottom panel underlying said lower section and providing a rigid support upon which supplies carried within said lower section are supported, whereby a display item may be placed on said transparent panel and viewed therethrough from the bottom of said lower section;

means pivotally coupling said upper section with said lower section for movement between a closed position wherein the floor of said upper section extends over said lower section in extension between the walls thereof to substantially cover said lower section, and an open position wherein the interior of said lower section is acccessible from the top.

10. A combination as set forth in claim 9, including an open centered press member in said lower section overlying said transparent panel in extension substantially around the periphery thereof, the floor of said upper section pressing said press member downwardly when the upper section is closed to press the display item downwardly against said transparent panel.

* * * * *